United States Patent [19]

Ramachandran

[11] 3,954,630

[45] May 4, 1976

[54] POST-WASH FABRIC TREATING COMPOSITION AND METHOD

[75] Inventor: Pallassana Ramachandran, Robinsville, N.J.

[73] Assignee: Colgate-Palmolive Company, New York, N.Y.

[22] Filed: Oct. 15, 1974

[21] Appl. No.: 514,755

Related U.S. Application Data

[62] Division of Ser. No. 286,995, Sept. 7, 1972.

[52] U.S. Cl. ..... 252/8.6; 8/137; 8/139; 252/8.8; 252/142

[51] Int. Cl.[2] ..... B08B 3/00

[58] Field of Search ..... 252/8.75, 8.8, 8.6, 252/142; 8/137, 139

[56] References Cited

UNITED STATES PATENTS

| | | | |
|---|---|---|---|
| 3,637,495 | 1/1972 | Eckert et al. | 252/8.6 X;8.8 |
| 3,644,204 | 2/1972 | Heins et al. | 252/8.6 X;8.8 |
| 3,676,353 | 7/1972 | Ciko | 252/142 |
| 3,686,025 | 8/1972 | Morton et al. | 252/8.75 X |

OTHER PUBLICATIONS

Speel, *Textile Chemicals and Auxiliaries*, pp. 296, 325, 390–396, 398–404, 409–410, (Reinhold 1957).

Speel et al., *Textile Chemicals and Auxiliaries*, pp. 382–383, 409, 510, (Reinhold, 1957).

*Chem. of the Metal Chelate CPDS*, Martell et al., pp. 28, 71, 94, 96, 107, 122–125, 132, 194–196, 393, 440–441, 445, 508, 510, 541, 544, (Prentice–Hall 1952).

*Primary Examiner*—Murray Tillman
*Assistant Examiner*—T. De Benedictis, Sr.
*Attorney, Agent, or Firm*—Steven J. Baron; Norman Blumenkopf; Herbert S. Sylvester

[57] ABSTRACT

A fabric treating composition for use in preventing the staining of fabrics consisting essentially of an aqueous solution of a complexing acid and a cationic fabric softening agent, the complexing acid and the softening agent being present in amounts so that on dilution with water the complexing acid comprises from 0.01 to 0.1% by weight of the dilution and the softening agent comprises from 0 to 0.1% of the dilution.

9 Claims, No Drawings

POST-WASH FABRIC TREATING COMPOSITION AND METHOD

This is a divisional application of Ser. No. 286,995 filed on Sept. 7, 1972, the benefit of which filing date is claimed.

This invention relates to a post-washing treating composition and method for using the same. More particularly, this invention relates to a post-washing treating composition and method which effectively prevents staining or yellowing of fabrics by metal ions.

Although cationic fabric treating fabric softening agents have been known and utilized since the early 1930's, the use of the cationic fabric treating agents has decreased as compared to the nonionic fabric softening agents since the cationic fabric softening agents have a marked tendency to impart a yellowness to fabrics which are continually treated with the same. Furthermore, the cationic fabric softening agents can only be utilized in the rinse cycle since the majority of commercially available detergents are of the anionic type and are not compatible with these cationic fabric softening agents. The cationic fabric softening agents, although less preferred, are generally less expensive to utilize and, accordingly, it would be desirable to be able to utilize such cationic agents in the rinse cycle without causing the fabrics to become yellowed.

In addition to yellowness imparted by cationic fabric softening agents, the fabrics are often stained by metal cations present in various soils, especially clay type soils. Up to now the only means for treating these metal type stains was the removal of the stains subsequent to their setting on the fabrics by way of bleaching and repeated washing. Each of these treatments, of course, is not completely satisfactory since continued bleaching of fabrics tends to degrade the same and shortens their useful life. The continued washing is not completely effective in removing the stains and tends to impart a certain boardiness to the fabrics, thus necessitating the use of a fabric softener.

Although complexing acids, such as citric acid, and the salts of these acids have been recently employed as supplemental builders for use in conjunction with various detergent compositions as replacements for the phosphate and nitrilo type builders previously employed, these materials have not been utilized in post-washing fabric treating compositions, such as fabric softeners. Citric acid and the other complexing acids have found utility for a wide number of uses ranging from a use as a wall paper paste remover to use as an active ingredient in a detergent composition for removing fishy type odors.

It is, therefore, within the above environment and disadvantages that the composition and process of the present invention has been developed. Briefly, the fabric treating composition of the present invention which is for use in preventing the staining of fabrics consists essentially of an aqueous solution of a complexing acid selected from the group consisting of citric acid, maleic acid, tartaric acid, fumaric acid, adipic acid, succinic acid and mixtures thereof and a cationic fabric softening agent such that on dilution with water the resulting composition contains from 0.01 to 0.1% by weight of complexing agent and from 0 to 0.1% by weight of softening agent. The method of the present invention comprises a method for preventing the yellowing or staining of fabrics comprising treating a fabric in the rinse with an aqueous solution consisting essentially of water, a complexing acid selected from the group consisting of citric acid, maleic acid, tartaric acid, fumaric acid, adipic acid, succinic acid and mixtures thereof and a cationic fabric softener, the complexing acid and cationic fabric softener being present in amounts sufficient to produce a concentration of from about 0.01 to 0.10% by weight of the acid and from about 0 to 0.10% by weight of the cationic fabric softener.

It is, therefore, the primary object of the present invention to provide a fabric treating composition which effectively prevents yellowing and staining of fabrics.

It is a further object of the present invention to provide a method for preventing the staining and yellowing of fabrics by rinsing the fabrics in a solution consisting essentially of water, a complexing acid and a cationic fabric softener.

It is a still further object of the present invention to provide a method wherein the fabrics are treated so as to prevent the same from being stained by the subsequent soiling with mineral containing soils.

It is a still further object of the present invention to provide a method for preventing fabrics from yellowing through the continued use of a cationic fabric softening agent.

Still further objects and advantages of the composition and process of the present invention will become more apparent from the following, more detailed description thereof.

The composition of the present invention which obviates the above disadvantages and which is for use in preventing the staining or yellowing of fabrics consists essentially of an aqueous solution of a complexing acid selected from a group consisting of citric acid, maleic acid, tartaric acid, fumaric acid, adipic acid, succinic acid and mixtures thereof, and a cationic fabric softening agent in an amount sufficient to produce, upon dilution, a concentration of from 0.01 to 0.1% by weight of complexing acid and 0 to 0.1% by weight softening agent.

The process of the present invention comprises rinsing a fabric in an aqueous solution consisting essentially of water, a complexing acid and a cationic fabric softening agent wherein the cationic fabric softening agent and the complexing acid are present in amounts sufficient to produce a concentration of from 0.01% to 0.10% by weight of the complexing acid and from 0 to 10.10% by weight of the cationic fabric softening agent.

The primary ingredient in the composition of the present invention is the complexing acid which is selected from citric acid, maleic acid, tartaric acid, fumaric acid, adipic acid, succinic acid and mixtures thereof. The preferred acids are citric and tartaric acid with citric being most preferred.

The complexing acid may be present in the final diluted rinse solution in an amount ranging from 0.01 to 0.1% by weight and preferably 0.02 to 0.05% by weight. Of course, it will be most convenient to utilize a concentrated solution of the acid for consumer convenience and packaging economies. Generally, since most top loading washing machines have from 15 to 20 gallon capacity, the concentrated form of the composition will generally comprise from 2 to 25% by weight of acid in a water solution. The important parameter is the dilution concentration so any concentrate composition will be solely for convenience in use.

In use, a small amount of the complexing acid is deposited on the fabric so as to provide active complexing sites for metal ions contained in soils, etc. In essence, the present composition and process are of a preventative nature since, by depositing a small amount of acid on the fabric, future metal stains are virtually eliminated. The same complexing acid also prevents the yellowing of fabrics due to a build-up of cationic fabric softeners.

Fabric softeners must be strongly attracted to fabrics in order to function properly; however, this attraction which is especially strong in cationic softeners also causes softener buildup or yellowing. The complexing acids, when used in conjunction with cationic fabric softeners lessen the tendency to build-up without interfering with their softening function.

Although in conventional compositions and processes, the salts of these organic, complexing acids are often utilized with similar or equivalent results, the sodium salts of the above noted acids as well as the other alkaline and the alkaline earth salts do not have the complexing properties necessary for the enhancement of the removal of the soil from the fabric. Accordingly, in the process and composition of the present invention, only the acids themselves and not their salts may be utilized.

Furthermore, only the organic complexing acids aid in the removal of these ions since the removal is not a function of pH as demonstrated by the inability of mineral acid solutions to effectively prevent staining from irremovable metal ions. Also, these latter acids are too strong for continued use since they tend to degrade the fibers.

The cationic fabric softening compounds useful in the composition of the present invention generally comprise cationic nitrogen containing compounds, such as quaternary ammonium compounds and amines containing one or two straight chained organic radicals of at least 8 carbon atoms and preferably containing at least one straight chained organic radical containing from 12 to 22 carbon atoms.

Generally, the quaternary ammonium softening agents have the following formulas

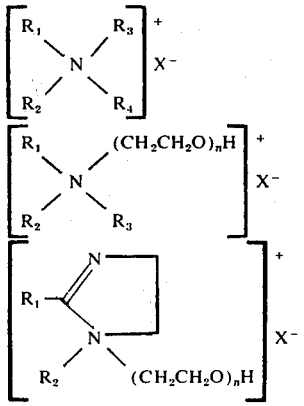

wherein $R_1$ is a long chain aliphatic radical having from 8 to 22 carbon atoms, $R_2$ is a long chained aliphatic radical having from 8 to 22 carbon atoms or is a lower alkyl radical having from 1 to 4 carbon atoms, $R_3$ and $R_4$ are lower alkyl radicals, n is a number between 1 and 15 and X is a water soluble salt forming anion, such as a halide, i.e. chloride, bromide, iodide; a sulfate, acetate, hydroxide, methasulfate or similar inorganic or organic solubilizing mono- or dibasic radical. Examples of quaternary ammonium softening agents suitable for use in the composition of the present invention include the following: hydrogenated ditallow dimethyl ammonium chloride, ethoxylated distearyl dimethyl ammonium chloride, 1-hydroxyethyl-1-methyl-2-heptadecyl imidazolinium chloride; dimethyl distearyl ammonium chloride; trimethyl stearyl ammonium bromide; cetyl trimethyl ammonium chloride, di-coco dimethyl ammonium chloride; cetyl pyridinium chloride; higher alkyl dimethyl benzyl ammonium chloride; di-isobutyl phenoxy ethoxy ethyl dimethyl benzyl ammonium chloride; lauryl isoquinolinium bromide; distearyl dimethyl quaternary ammonium bromide; distearyl dimethyl quaternary ammonium methylsulfate; dicoco dimethyl quaternary ammonium chloride; dimethyl arachidyl, behenyl quaternary ammonium chloride; di-(soya) dimethylammonium chloride, and di-(coco) dimethylammonium chloride.

Examples of amines which may be utilized in the composition of the present invention include primary tallow amine, primary coco amine, primary halogenated tallow amine, n-tallow 1,3-propylene diamine, oleyl 1,3-propylene diamine, and coco 1,3-propylene diamine.

The term "coco" when utilized refers to fatty acid groups formed in coconut oil fatty acids. Such acids contain from about 8 to 18 carbon atoms per molecule predominating in the $C_{12-14}$ acids.

Although the process and composition of the present invention are operative without the use of the cationic softeners, it is a preferred embodiment to utilize a mixture of the complexing acid and softener in a solution. Generally, the softener comprises from 0 to 0.1% by weight of the rinse water subsequent to dilution and preferably from 0.01 to 0.03% by weight. As with the acid, the softener will have a similar concentration in the concentrate, i.e. from 0 to 25% by weight.

Another important factor in the composition of the present invention is the ratio by weight of the cationic agent to the anti-yellowing agent, i.e. the complexing acid, since within certain ratios the non-yellowing properties are most evident. This ratio is generally from 1:1 to approximately 1:5 softener to acid with optimun results being obtained at a ratio of approximately 1:2.

Furthermore, it has been found that the process of the present invention is not basically temperature dependant and performs well using cold and warm water rinse solutions. Also, the process can be conducted using water of any reasonable degree of hardness although, obviously, the use of softer rinse water is preferred.

Since the composition of the present invention in use tends to acidify the rinse water, a number of additional beneficial results have been noted, namely permanent press resins tend to be more stable and calcium precipitants such as $CaCO_3$ tend to be removed leaving the fabrics with a better hand and feel.

The composition of the present invention will now be more fully illustrated by way of the following specific examples which are for the purpose of illustration only and are in no way to be considered as limitive of the composition of the present invention. In the following examples, all parts and percentages are by weight and all temperature in degrees farenheit.

EXAMPLE 1 AND COMPARATIVE EXAMPLES 1 AND 2

Three series of identical 50/50 polyester cotton permanent press swatches are soiled with a clay soil. These soiled swatches are then washed with a detergent as a 1.5 g/liter concentration using a water having a hardness of 150 ppm. The detergent composition is 10% tridecylbenzene sulfonate, 2% $C_{14-15}$ etoxylated (11E0) alcohol, 1% sodium soap, 33% sodium carbonate, and 7% sodium silicate. These series or sets of swatches are then rinsed with the following rinse composition as set forth in Table I. The swatches are then soiled, washed and rinsed in this manner four additional times. The reflectance (Rd values) after the first and fifth wash are shown below with a higher Rd value indicating increased whiteness.

TABLE I

| Example No. | Rinse | Rd After 1st Wash | Rd After 5th Wash |
|---|---|---|---|
| Comp. Ex. 1 | Water (150ppm) | 75.5 | 59.7 |
| Comp. Ex. 2 | HCl + Water pH = 4 | 76.9 | 62.3 |
| Example 1 | 0.02% Citric Acid in Water pH = 4 | 77.8 | 67.8 |

As is evident from Table I, the utilization of citric acid produces an increased whiteness from the first wash through the fifth wash with the whiteness becoming more apparent after a greater number of washings. Since the citric acid and hydrochloric acid rinses both have the same pH, this shows that the increased whiteness obtained is not a function merely of pH but can be obtained only utilizing an organic complexing acid, such as citric acid. In each of the above noted rinse solutions, the water which is utilized has a hardness of 150 ppm.

EXAMPLE 2

Utilizing the procedure of Example 1, the citric acid rinse is replaced by the following organic complexing acid rinse solutions: (A) 0.01% tartaric acid; (B) 0.05% maleic acid; (C) 0.1% fumaric acid; (D) 0.02% adipic acid; (E) 0.06% of a 50/50 mixture of maleic acid and citric acid; and (F) 0.08% citric acid.

When compared to a similar swatch of fabric rinsed only in plain water of a similar hardness, the swatches rinsed in the above acid solutions show increased whiteness. This increased whiteness is evident from the first wash and the whiteness differential increases with every subsequent wash.

COMPARATIVE EXAMPLE 3

In order to show the inoperability of the alkali metal salts of the organic complexing acids utilized in the composition of the present invention, the procedure of Example 1 is repeated with the exception that the following salt solutions are utilized as the rinse solution: (A) 0.01% of the sodium salt of tartaric acid; (B) 0.05% of the potassium salt of maleic acid; (C) 0.1% of the ammonium salt of fumaric acid; (D) 0.02% of the sodium salt of adipic acid; (E) 0.06% of the sodium salts of a 50/50 mixture of maleic acid and citric acid; and (F) 0.08% of the sodium salt of citric acid.

When the swatches rinsed in each of the above solutions are compared both with similar swatches using a plain water rinse and with the swatches of Example 2, the difference in whiteness and feel of the swatches is immediately apparent with the whiteness of the swatches rinsed in accordance with Example 2 being whiter than the corresponding swatches rinsed in accordance with Comp. Ex. 3.

EXAMPLE 3 AND COMPARATIVE EXAMPLE 4

Two sets of cotton terry towel swatches are rinsed three times utilizing the rinse solutions as shown in Table II.

TABLE II

| Example No. | Rinse | Rd Value | "b" value |
|---|---|---|---|
| Comp. Ex. 4 | 0.01% solution of N tallow propylene diamine | 74.9 | 4.0 |
| Example 3 | 0.01% N-tallow propylene diamine + 0.02% citric acid | 82.5 | 2.7 |

The above rinse solutions are conducted at a temperature of approximately 120°F. Which corresponds to a normal warm water rinse. In Table II, the Rd value is the whiteness with higher values indicating increased whiteness and the "b" values indicate yellowness with higher values indicating increased yellowness. As is immediately apparent, the terry towel swatches which are rinsed in the diamine + citric acid show improved results over those rinsed in just the diamine alone. Furthermore, the softening of each set of swatches is approximately equal.

EXAMPLE 4 AND COMPARATIVE EXAMPLE 5

The procedure of Example 3 and Comp. Example 4 is repeated with the exception that the rinse solutions are maintained at a temperature of 70°F, i.e. a cold water rinse. The results are shown in Table III.

TABLE III

| Example No. | Rinse | Rd Value | "b" Value |
|---|---|---|---|
| Comp. Ex. 5 | 0.01% solution of N-tallow propylene diamine | 75.6 | 4.4 |
| Example 4 | 0.01% N-tallow propylene diamine-0.02% citric acid | 81.3 | 3.5 |

Again, the diamine + citric acid produces superior results when compared to the diamine alone. This indicates that the temperature of the rinse water has little, if any, effect on the decreased yellowness and increased whiteness of the composition of the present invention.

EXAMPLE 5

The procedure of Example 3 is repeated with the exception that the following cationic fabric softener and organic acid rinses are utilized: (A) 0.1% 1-hydroxyethyl-1-methyl-2-heptadecyl imidazolinium chloride and 0.1% citric acid; (B) 0.01% dimethyl distearyl ammonium chloride and 0.05% maleic acid; (C) 0.04% trimethyl stearyl ammonium bromide and 0.08% tartaric acid; (D) 0.03% lauryl isoquinolinium bromide and 0.10% succinic acid; (E) 0.05% oleyl 1,3-propylene diamine and 0.1% fumaric acid; and (F) 0.2% primary tallow amine and 0.1% of a 50/50 mixture of citric acid and adipic acid.

Each of the above compositions when compared to a rinse composition utilizing only the cationic softening agent has increased whiteness and decreased yellowness with no apparent differentiation in degree of softening.

As is apparent by way of the foregoing examples which are for the purposes of illustration only, the composition and process of the present invention provide a rinse cycle treatment composition and process which reduces the yellowing caused by cationic softening agents and increases whiteness.

What is claimed is:

1. A post-washing composition adapted to be diluted with water consisting essentially of an organic complexing acid, a quaternary ammonium softening agent and water, said organic complexing acid and said softening agent being present in a concentration sufficient so that upon dilution, the concentration of organic complexing acid is from 0.01 to 0.1% by weight and the concentration of said softening agent is from 0.01 to 0.1% by weight, said organic complexing agent selected from the group consisting of citric acid, maleic acid, tartaric acid, fumaric acid, adipic acid, succinic acid and mixtures thereof and being operative to substantially reduce yellowness imparted to fabrics by said cationic softening agent, said softening agent being selected from the group of compounds having the following formulas

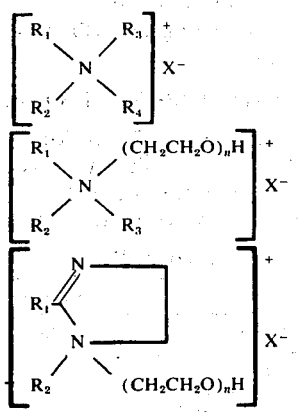

wherein $R_1$ and $R_2$ are long chain aliphatic radicals having 8 to 22 atoms, or alternatively $R_2$ is a lower alkyl radical having 1 to 4 carbon atoms, $R_3$ and $R_4$ are lower alkyl radicals, n is a number between 1 and 15 and X is a water soluble salt forming anion.

2. The composition of claim 1 wherein the ratio of said complexing acid to said cationic softening agent is from 1:1 to 5:1.

3. The composition of claim 2 wherein said ratio is approximately 2:1.

4. The composition of claim 1 wherein said organic complexing acid is citric acid.

5. The composition of claim 1 wherein said cationic fabric softening agent is N-tallow propylene diamine.

6. The composition of claim 1 wherein said anion is selected from the group consisting of halide, sulfate, acetate, hydroxide and metasulfate.

7. The composition of claim 1 wherein said softening agent is selected from the group consisting hydrogenated ditallow dimethyl ammonium chloride, ethoxylated distearyl dimethyl ammonium chloride, 1-hydroxyethyl-1-methyl-2-heptadecyl imidazolinium chloride; dimethyl distearyl ammonium chloride; trimethyl stearyl ammonium bromide; cetyl trimethyl ammonium chloride, di-coco dimethyl benezyl ammonium chloride; cetyl pyridinium chloride; higher alkyl dimethyl benezyl ammonium chloride; di-isobutyl phenoxy ethoxy ethyl dimethyl benzyl ammonium chloride; lauryl isoquinolinium bromide; distearyl dimethyl quaternary ammonium bromide; distearyl dimethyl quaternary ammonium methylsulfate; dicoco dimethyl quaternary ammonium chloride; dimethyl arauhidyl, behenyl quaternary ammonium chloride; di-(soya) dimethylammonium chloride and di-(coco) dimethylammonium chloride.

8. A substantially non-yellowed fabric treated with a composition as defined in claim 1.

9. A substantially non-yellowed fabric treated with a composition as defined in claim 1 subsequent to laundering of said fabric.

* * * * *